United States Patent [19]

Reed

[11] 4,448,247

[45] May 15, 1984

[54] GEOTHERMAL WELL HEAD CLEAN OUT AND SHUT OFF ASSEMBLY

[75] Inventor: Lehman T. Reed, Bakersfield, Calif.

[73] Assignee: Midway Fishing Tool Company, Long Beach, Calif.

[21] Appl. No.: 414,903

[22] Filed: Sep. 3, 1982

[51] Int. Cl.[3] ..... E21B 33/068

[52] U.S. Cl. ..... 166/82; 166/311; 166/379; 15/104.16; 137/244; 137/245.5

[58] Field of Search ..... 166/311, 82, 75 R, 85, 166/379; 137/15, 244, 245, 245.5; 15/104.16

[56] References Cited

U.S. PATENT DOCUMENTS

| | | | |
|---|---|---|---|
| 2,261,440 | 11/1941 | Layne | 166/85 |
| 3,830,304 | 8/1974 | Cummins | 166/85 |
| 4,184,504 | 1/1980 | Carmichael et al. | 137/15 |
| 4,190,113 | 2/1980 | Harrison | 166/311 |

*Primary Examiner*—Ernest R. Purser
*Assistant Examiner*—Mark J. Del Signore
*Attorney, Agent, or Firm*—William C. Babcock

[57] ABSTRACT

An assembly for cleaning deposited minerals from the interior passages of first and second axially aligned tubular laterals that extend outwardly in opposite directions from a geothermal well head and removably support first and second gate valves from the free ends thereof. The cleaning of the passages in the tubular laterals as well as passages in the first and second gate valves may be conducted with the assembly without killing the well. The assembly also permits a third vertically disposed gate valve on the well head to be removed for repair and maintenance purposes without killing the well, and this is also possible with the first and second gate valves.

14 Claims, 15 Drawing Figures

FIG. 11
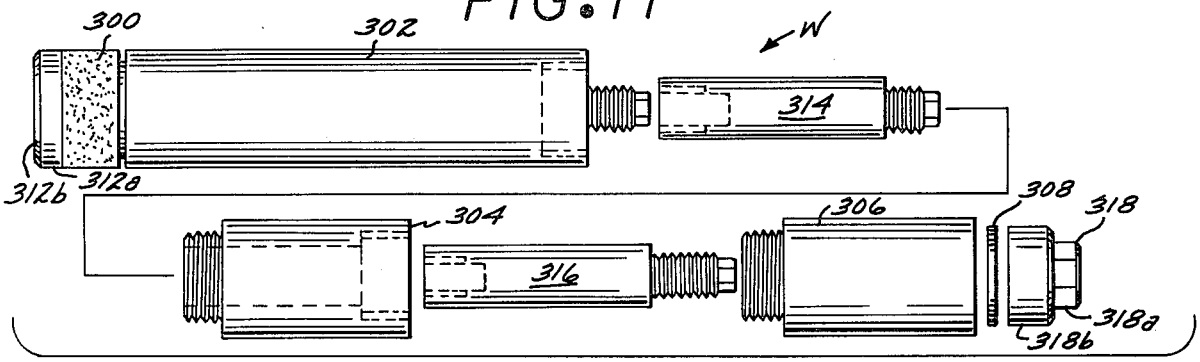
FIG. 12
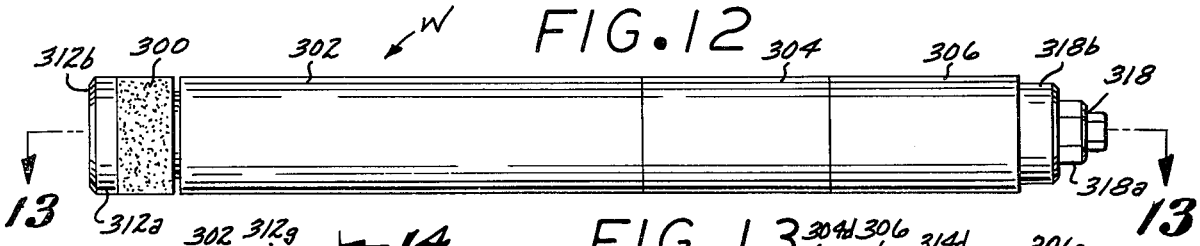
FIG. 13
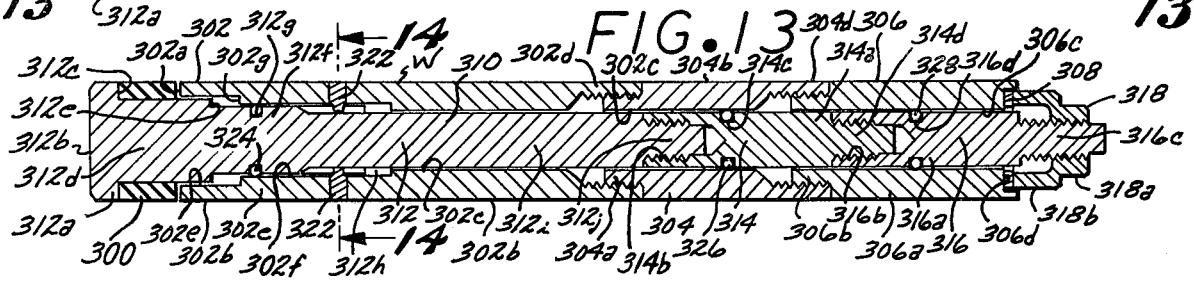
FIG. 14
FIG. 15
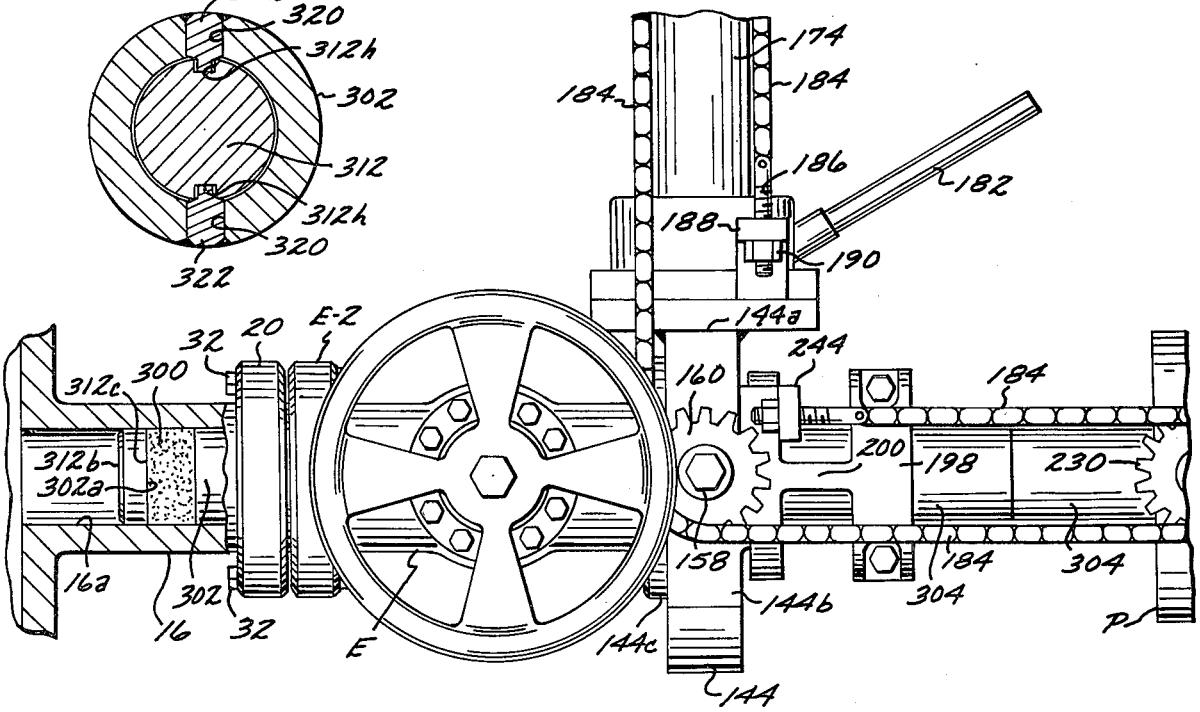

GEOTHERMAL WELL HEAD CLEAN OUT AND SHUT OFF ASSEMBLY

CROSS REFERENCE TO RELATED APPLICATIONS

"Geothermal Well Head and Actuator Assembly", patent application Ser. No. 291,377 filed by applicant of the present application in the United States Patent Office on Aug. 10, 1981.

BACKGROUND OF THE INVENTION

In recent years, the production of pressurized fluid from geothermal wells has increased substantially as a source of power. The pressurized fluid produced from such geothermal wells either has minerals dissolved therein or entrained therewith, which minerals as the fluid flows from the well tend to be deposited as hard layers in the passages of gate valves and tubular members used in supporting the gate valves on the well head. The depositing of such materials is objectionable, in that, it restricts the transverse cross sections of the passages through which the fluid may flow, and also impairs the operation of the gate valves.

On the normal geothermal well head there will be two oppositedly disposed, axially aligned gate valves that control the flow of pressurized fluid to pipe lines connected thereto. These gate valves are frequently situated in cramped quarters, such as a cellar, and in the past have only been cleanable by killing the well so that they may be removed for maintenance purposes. The killing of a geothermal well is undesirable, in that frequently after the killing the well does not come back to production and the well may even be lost.

A major object of the present invention is to provide an assembly that permits the passages in oppositedly disposed gate valves and tubular members supporting the latter from a geothermal well head to be cleaned of deposited hard minerals, and this operation capable of being carried out without killing the well. Also, the present invention permits the interior of the well head to be sealed, so that a third gate valve that is vertically disposed there above may be removed from the well head for repairs. Repair of the third gate valve is again possible without killing the geothermal well.

SUMMARY OF THE INVENTION

The present invention is used in combination with a geothermal well that includes casing that extends downwardly from a first flange to a geothermal zone from which pressurized fluid containing minerals flow. The well head includes a substantially vertical first tubular member that has a lower second flange, an upper third flange, first and second axially aligned lateral tubular members that extend outwardly therefrom in opposite directions to terminate in fourth and fifth flanges. First, second and third flange gate valves are secured to the fourth, fifth and third flanges with each of the gate valves having a longitudinal passage therein. The first and second gate valves are connected to pipes that extend to an area in which the pressurized geothermal fluid is to be used.

The present invention is an assembly for cleaning deposited solid materials from the tubular lateral members and passages in the first and second gate valves without shutting down the geothermal well. When the invention is used, the pipe is disconnected from the outer end of the first gate valve after the latter has been placed in a closed position.

The assembly of the present invention includes a second substantially vertical tubular member that is axially aligned with the third gate valve and removably secured to the upper end thereof. A hydraulic assembly is removably secured to the upper end of the second tubular member and is situated above the latter.

The hydraulic assembly includes a hydraulic cylinder that has upper and lower ends. A piston is slidably and sealingly mounted in the cylinder, with the piston having a first piston rod that extends downwardly therefrom through the lower end of the cylinder into the second tubular member to terminate in a lower end.

A second piston rod extends upwardly from the piston through the second end. First means are provided for concurrently rotating the second piston rod, piston and first piston rod relative to the hydraulic cylinder. Insignias are provided on the cylinder and the second piston rod for visually indicating the longitudinal position and degree of rotation of the piston relative to the cylinder. Conventional means are provided for discharging a pressurized fluid into and out of the hydraulic cylinder to move the piston longitudinally therein.

A plug assembly is provided that includes a first generally cylindrical body that has upper and lower ends and a transverse bore that may be axially aligned with the first and second tubular laterals when the plug assembly is disposed within the first tubular member. Alignment of the transverse bore with the first and second tubular laterals is made possible by movement of the piston and use of the insignias to rotate the first body of the plug assembly to a degree that the bore is axially aligned with the tubular laterals.

A second body forms a part of the plug assembly and rotatably and threadedly engages the upper end of the first body. A circumferential, resilient sealing member is supported on the first body and expands and contracts radially when the second body is rotated between first and second positions. The second body has engageable means on the upper end thereof. The plug assembly is of a longitudinal length that is less than that of the second tubular member. The plug assembly when not in use is situated above the third gate valve within the confines of the second tubular member.

The first piston rod has engaging means on the lower end thereof that may removably engage the engageable means to raise and lower the plug assembly in conformity to the movement of the piston. In addition, the engaging means when in engagement with the engageable means permits rotation of the plug assembly as a unit when the seond body is not restrained as to rotational movement.

A number of elongate rigid members are provided that except for a first member thereof, have first and second ends that permit said members to be sequentially connected to one another in end to end relationship. The first member has a first end of such structure as to scrape deposited minerals from the passage of the first gate valve, the first lateral tubular member, the interior of the second tubular lateral as well as the passage in the second gate valve. The second ends of the rigid members have cavities of non-circular transverse cross section extending longitudinally therefrom, which passages may be removably engaged by a wrench to permit rotation of the rigid members.

An elongate member advancing structure is secured to the first valve after the pipe normally connected thereto has been removed therefrom, with the removal of the pipe being done after the first gate valve has been placed in a closed position. The elongate member advancing structure is adapted to move the first rigid member and succeeding rigid members connected thereto through the entire passage in the first gate valve after the latter has been placed in an open position, through the passage in the first tubular lateral and through the bore in the first body after the plug assembly has been moved downwardly where the bore is axially aligned with the passages in the first and second tubular laterals. The first rigid member after passing through the bore in the plug assembly engages the interior of the second tubular lateral to remove deposited minerals therefrom. Removal of deposited hard minerals from the tubular laterals is facilitated by the leading elongate rigid member having a toothed first end that both scrapes and reams the material from the passages as moves longitudinally therethrough with concurrent rotation.

When the bore of the plug assembly is engaged by the connected elongate rigid members it is restrained from moving upwardly in the first tubular member due to the force exerted thereon by the pressurized fluid. When the first and second piston rods and piston are concurrently rotated in a first direction with the engageable means in engagement with the engaging means, the second body of the plug assembly will move downwardly relative to the first body to radially expand the resilient member into sealing contact with the interior surface of the first tubular member above the entry into the first and second tubular laterals.

The engageable means and engaging means may now be separated from one another to permit the third gate valve, second tubular member, hydraulic cylinder, piston, and first and second piston rods to be separated from the first tubular members for maintenance work to be performed on the third gate valve and hydraulic cylinder, without shutting down the geothermal well. After the third gate valve and hydraulic cylinder have been repaired, they are returned to their initial position. The rigid elongate member advancing structure is now placed in a position where the pressure of the geothermal fluid on the free end of the first elongate member force it and the members connected thereto outwardly relative to the structure, with the members being sequently gripped by the structure, and the non-circular cavity in the second end of each outermost rigid member being engaged by a wrench to unscrew it from the elongate member most adjacent thereto. After the elongate members have been removed as above described, the elongate member advancing structure may be removed from the second valve, and the pipe initially connected thereto again placed in communication therewith.

BRIEF DESCRIPTION OF THE DRAWINGS

FIG. 11 is an exploded side elevational view of a tool that may be used with the invention shown in FIG. 2 to removably plug the interior of the second tubular lateral to permit the second gate valve to be removed for maintenance purposes without killing the well;

FIG. 12 is the same view as shown in FIG. 11 but with the tool assembled;

FIG. 13 is a longitudinal cross sectional view of the assembled tool taken on the line 13—13 of FIG. 12;

FIG. 14 is a transverse cross sectional view of the tool taken on the line 14—14 of FIG. 13; and FIG. 15 is a combined side elevational and longitudinal cross sectional view of the first tubular lateral member, first gate valve and the advancing mechanism, with the tool being advanced to plug the second tubular lateral opposite the first tubular lateral.

DESCRIPTION OF THE PREFERRED EMBODIMENT

The invention A is used in conjunction with a geothermal well B that includes a casing C that extends downwardly from a first flange 10 to a pressurized fluid producing geothermal zone (not shown). Fluid from the zone contains minerals that tend to be deposited as hard layers on the interior surface of tubular members through which the fluid flows.

Figure 1:
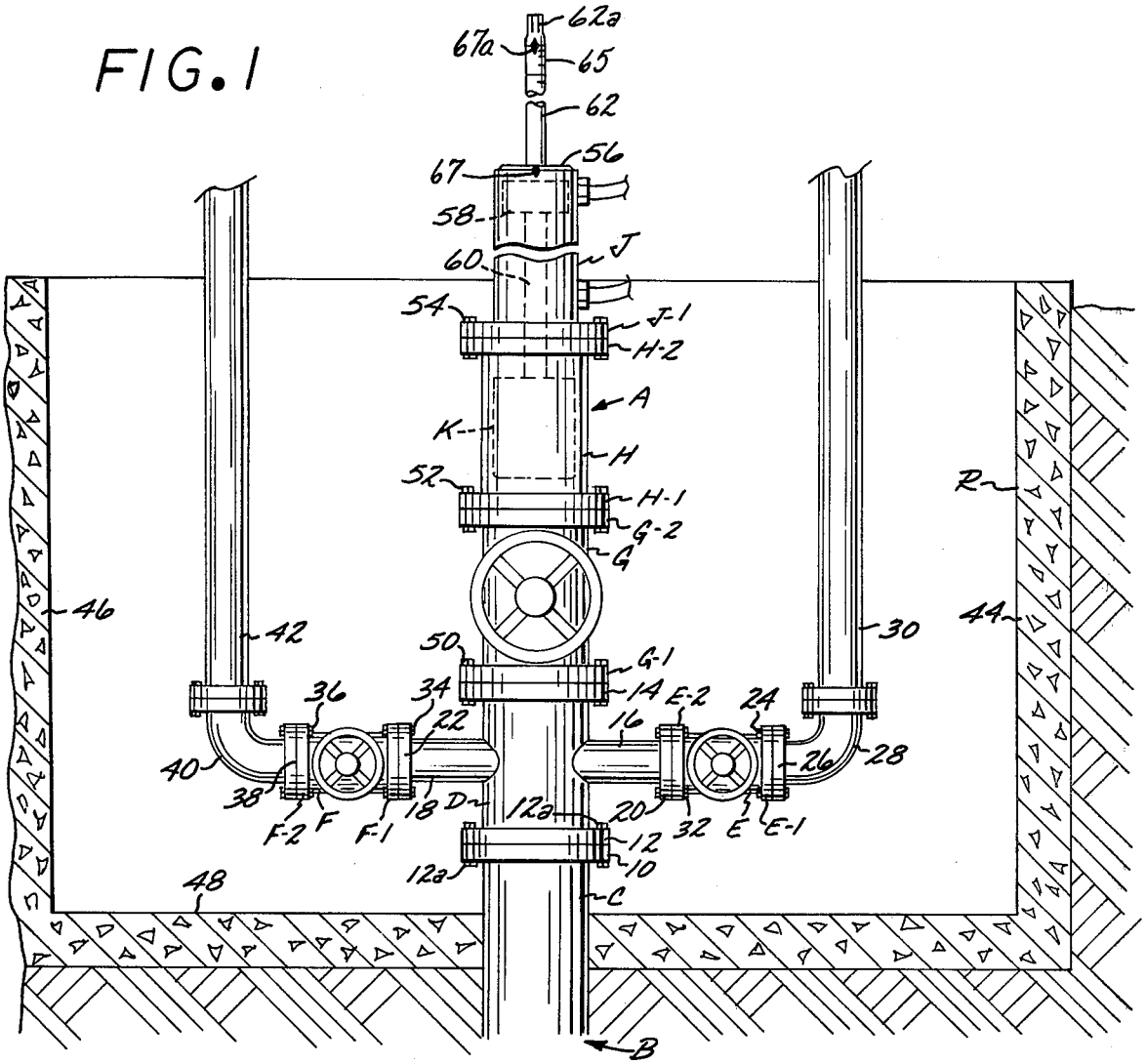
FIG. 1 is a side elevational view of a geothermal well head assembly disposed in a cellar, which well head assembly includes a first tubular member having first and second tubular lateral members extending outwardly therefrom in opposite directions that support first and second gate valves in communication with first and second pipes that conduct the geothermal fluid to a desired location, and the assembly also including a third vertically disposed gate valve that supports a second tubular member on which a hydraulic assembly is mounted.

In FIG. 1 it will be seen that a first vertical tubular member D is provided that has a second flange 12 on the lower end thereof, which second flange rests on the first flange 10 and is secured thereto by bolts 12*a*.

The first tubular member D includes an upper third flange 14, and first and second lateral tubular members 16 and 18 that extend outwardly from the tubular member in opposite directions and are intermediately disposed between the first and second flanges 12 and 14. The first and second tubular lateral members 16 and 18 are axially aligned.

The first and second tubular lateral members 16 and 18 have fourth and fifth flanges 20 and 22 secured to the outer ends thereof. First, second and third gate valves E, F and G are provided, with the first gate valve having first and second flanges E-1 and E-2 on the ends thereof. The second gate valve has flanges F-1 and F-2 on the ends thereof, Flanges G-1 and G-2 are provided on the upper and lower ends of third gate valve G.

The first flange E-1 of first gate valve E is secured to the fourth flange 20 by bolts 32. The first flange E-1 by bolts 24 is removably secured to a flange 26 that forms a portion of a tubular fitting 28 that has a first pipe 30 connected thereto for conducting geothermal fluid from the well B to a desired location.

Bolts 34 removably secure the first flange F-1 to the flange 22 as may best be seen in FIG. 1. The flange F-2 of second valve F is removably connected by bolts 36 to a flange 38 that forms a part of a tubular fitting 40. The fitting 40 has a pipe 42 extending therefrom through which geothermal fluid from the well may flow to a desired location.

The first, second and third gate valves E, F and G are illustrated in FIG. 1 as being located in a cellar R that includes a first wall 44, a second oppositely disposed wall 46, and a bottom 48. Bolts 50 removably secure the flange G-1 of the third gate valve G to the third flange 14 of the tubular member D. A second tubular member H as may best be seen in FIG. 1 has flanges H-1 and H-2 on the ends thereof, with the flange H-1 being secured to the flange G-2 by bolts 52.

A hydraulic cylinder J is provided which has a lower flange J-1 projecting outwardly from the lower end thereof, which flange by bolts 54 is removably secured to the flange H-2 of the second tubular member H. The hydraulic cylinder J has an upper end 56, and a piston 58 is slidably and sealingly mounted within the confines of the hydraulic cylinder.

A first piston rod 60 projects downwardly from the piston 58, and a second piston rod 62 extends upwardly through the upper end 56 of the hydraulic cylinder J, which second piston rod at all times has at least a portion thereof disposed above the upper end 56 of the hydraulic cylinder.

The second piston rod 62 has graduated insignia 65 defined thereon, which insignia indicate the longitudinal position of a plug assembly K that is removably secured to the lower end of the first piston rod 60. An insignia 67 defined on the upper end of the hydraulic cylinder J in cooperation with an insignia 67*a* situated on the second piston rod 62 cooperate to visually indicate the degree of rotation of the plug assembly K when the latter is situated within the interior of the first tubular member D.

The second piston rod 62 on the upper end 62*a* is of non-circular transverse cross section to permit the upper end 62*a* to be removably engaged by a wrench (not shown) to rotate concurrently the second piston rod 62, piston 58 and first piston rod 60, as well as the plug assembly K when the latter is connected to the first piston rod and is free to rotate within the first tubular member D.

Figures 2, 3, 4, 5:
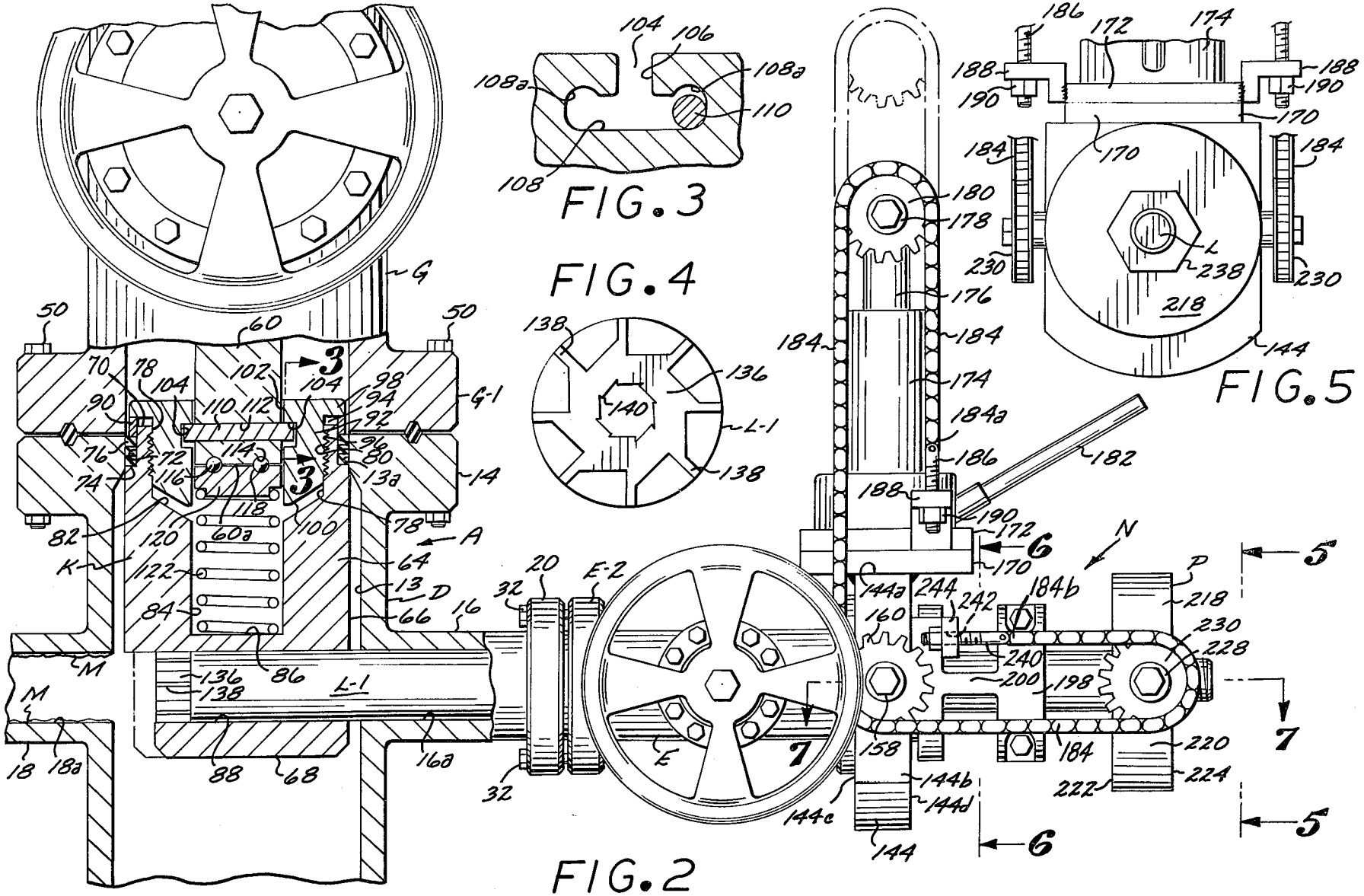
FIG. 2 is a fragmentary vertical cross sectional view of a portion of the first tubular member that has a plug sealingly disposed within the interior thereof and held in a fixed position therein by a succession of elongate rigid members connected end to end, which members have been forced through the first gate valve when it is in open position to enter the first tubular member to scrape material therefrom and pass through a transverse bore in the plug assembly to enter the second tubular lateral to remove foreign material therefrom, and this view illustrating the elongate member advancing mechanism.
FIG. 3 is a fragmentary side elevational view of the upper portion of the plug assembly illustrating an inverted T-shaped slot that may be engaged by a pin on the lower end of a first piston rod to rotate an upper portion of the plug assembly relative to a lower portion thereof, as well as to raise and lower the plug assembly relative to the first tubular member.
FIG. 4 is an end elevational view of a toothed first end of a first elongate member for reaming deposited minerals from the interior surface of a tubular member.
FIG. 5 is an end elevational view of the elongate member advancing mechanism taken on the line 5—5 of FIG. 2.
Figure 6:
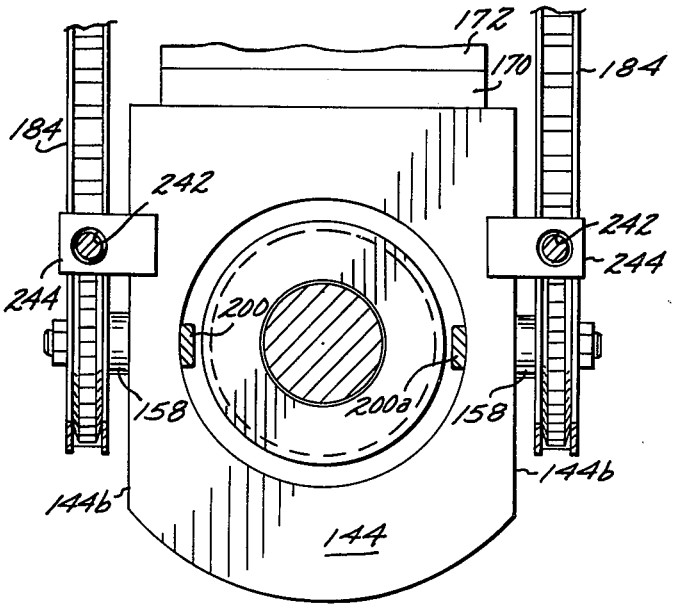
FIG. 6 is a combined vertical cross sectional view and end elevational view of a portion of the elongate member advancing mechanism taken on the line 6—6 of FIG. 2.

The plug assembly K as best seen in FIG. 2 includes a lower first rigid body 64 of generally cylindrical shape and of smaller transverse cross section than the interior side wall 13 of the first tubular member D. The first body 64 has a cylindrical side wall 66, a bottom 68, and a top 70. A circular recess 72 extends downwardly from the outer portion of the top 70 to terminate in a lower circular body shoulder 74 that serves as a support for a number of resilient packing rings 76 that encircle the body 64.

A circular opening 78 extends downwardly from the top 70 as shown in FIG. 2, which openings has threads 80 defined on the upper portion thereof. The opening 78 develops into a downwardly and inwardly tapering abutment 82, which abutment in turn develops into a downwardly extending cylindrical cavity 84 that has a bottom 86. A transverse bore 88 is formed in the first body 64 intermediate between the bottom 68 thereof and the bottom 86 of the cavity 84. The purpose of the transverse bore 88 will later be explained in detail.

A rigid ring 90 rests on the uppermost one of the packing rings 76, with the ring being slidably supported in the recess 72 and projecting upwardly thereabove as shown in FIG. 2. The plug assembly K as may be seen in FIG. 2 includes a second rigid body 92 that is at least partially disposed above the first body 64. The second body 92 has an external cylindrical side wall 94 that has threads 96 formed on the lower portion thereof that engage the threads 80 of the first body 64. The second body 92 includes a top portion 98 that projects outwardly therefrom and is capable of contacting the rigid ring 90 to exert a downward force on the latter.

The second body 92 includes a downwardly and inwardly tapering bottom 100 that is of substantially the same angle as the abutment 82. The second body 92 has a centered vertical bore 102 extending downwardly therethrough. The bore 102 is in communication with two oppositedly disposed inverted T-shaped slots 104 that extend outwardly therefrom and are situated in the upper portion of the bore. Each of the slots 104 as best seen in FIG. 3 includes a vertical leg 106 that on the lower end thereof is in communication with the center portion of a horizontal leg 108, which horizontal leg on the outer extremities thereof develops into upwardly extending end portions 108*a*.

A transverse bore 112 is formed in the first piston rod 60 adjacent the lower end 60*a* thereof, and supports a pin 110 that has end portions thereof projecting outwardly from the first piston rod 60. The lower end 60*a* of the first piston rod 60 has a circular groove 114 defined therein that engages ball bearings 116, which ball bearings also engage a circular groove 118 formed in the upper surface of a rigid plate 120 that is disposed in the cavity 84 and that is at all times urged upwardly by a helical spring 122. The lower end of the spring rests on the bottom 86 of the cavity 84.

When the first piston rod 60 is moved downwardly, and the pin 110 is properly oriented relative to the pair of slots 104, the outwardly projecting portions of the pin 110 may be moved downwardly through the vertical legs 106 of the slots 104 into the horizontal legs 108. After the pin 110 is so positioned, the pin by rotation of the piston rod 60 may be caused to engage either of the end portions 108*a* of the horizontal leg 108 of the pair of slots 104. Rotation of the piston rod 60 with the pin 110 so engaged permits the second rigid body 92 to be rotated relative to the first body 64. When the second body 92 is rotated in a first direction relative to the first body 64, the second body moves downwardly relative thereto, with the top portion 98 pressure contacting the rigid ring 90, and the ring being forced downwardly to compress the packing rings 96 to radially expand the same into sealing contact with the upper interior surface 13*a* of the first tubular member D. The upper interior surface 13*a* is of smaller diameter than the surface 13.

When the piston rod 60 is rotated in a second and opposite direction, the pin 110 engages opposite ends of the slot legs 108 to unscrew the second body 92 and causes it to move upwardly relative to the first body 64, with the ring 90 now being free to move upwardly to allow the resilient packers 76 to radially contract and assume their initial non-sealing position. After the second body 92 has been rotated to a desired extent relative to the first body 64, the pin 110 may have the projecting ends thereof aligned with the vertical legs 106 of the slots 104 and the pin 110 moved upwardly therethough by upward movement of the first piston rod 60.

Figure 10:
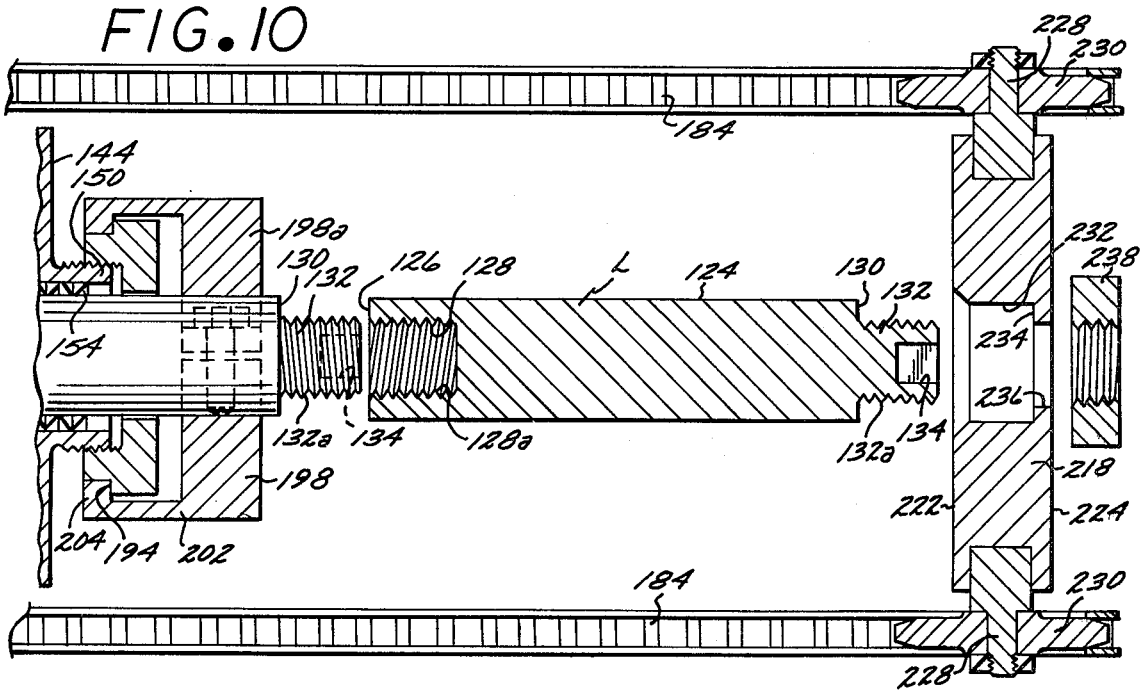
FIG. 10 is the same view as shown in FIG. 7, but with the force imparting member separated from the elongate rigid member that it engages, after the elongate rigid member has been threadedly connected to the second end of the elongate rigid member to the left thereof.

A number of elongate rigid members L are provided, each of which has a diameter slightly less than that of the passages 16*a* and 18*a* that extend longitudinally in the tubular lateral members 16 and 18. In FIG. 10 one of the elongate rigid members is shown in which it will be seen that it is defined by a cylindrical exterior side wall 124, a first end 126, which first end has a centered cylinder cavity 128 extending longitudinally therefrom. The cavity 128 has threads 128*a* formed on the interior thereof.

The rigid member L includes a second end 130 that has a centered extension 132 projecting outwardly therefrom that is of smaller diameter than that of the side wall 124. The extension 132 has threads 132*a* on the exterior thereof. The outer extremity of the extension 132 has a recess 134 of non-circular transverse cross section extending inwardly therefrom.

The recess 134 is adapted to be engaged by a wrench (not shown) to permit rotation of the elongate rigid members L. In FIG. 10 it will be seen that the elongate rigid members L may be removably disposed in end to end relationship by the threaded extension 132 engaging the threaded cavity 128 of a rearwardly situated elongate member. When the threaded extension 132 is engaged with a threaded cavity 128 the first end 126 of one elongate member L is in pressure abutting contact with the second end 130 of the elongate member forwardly thereof.

A first elongate rigid member L-1 is provided that is identical to the elongate rigid members L previously described, except the first end 126 of the member L is replaced by a ring shaped end 136 as best seen in FIG. 2 that has a number of circumferentially spaced teeth 138 extending outwardly therefrom as well as a number of inwardly extending teeth 140 that are circumferentially spaced from one another. By concurrent longitudinal and rotational movement of the first elongate rigid member L-1 in a direction to the left as viewed in FIG. 2, deposited mineral M may be cut and reamed from the passage 16*a* of the first tubular lateral 16, with the first elongate member L-1 then moving through the transverse bore 88 to enter the second passage 18*a* of the second tubular lateral 18 to remove deposited mineral M therefrom. The movement of the first elongate rigid member L-1 and the succeeding rigid members L that are removably connected thereto through the passage 16*a* of the tubular lateral 16 is only possible when the first gate valve E is in an open position.

The elongate rigid member advancing mechanism N that makes such movement of the elongate members L and L-1 possible is shown to the right of the first gate valve E in FIG. 2. The mechanism N is removably secured to the flange E-1 of the first gate valve E. When the first flange E-1 is connected to the flange 26 of fitting 28, the fitting must be removed from the first flange E-1 prior to the advancing mechanism N being mounted on the first gate valve E. If desired, the rigid member advancing mechanism N may be allowed to remain in place on the first gate valve E. Irrespective of whether the elongate rigid member advancing mechanism N is temporarily or permanently secured to the first gate valve E, the operation of the mechanism N is the same.

Figure 7:
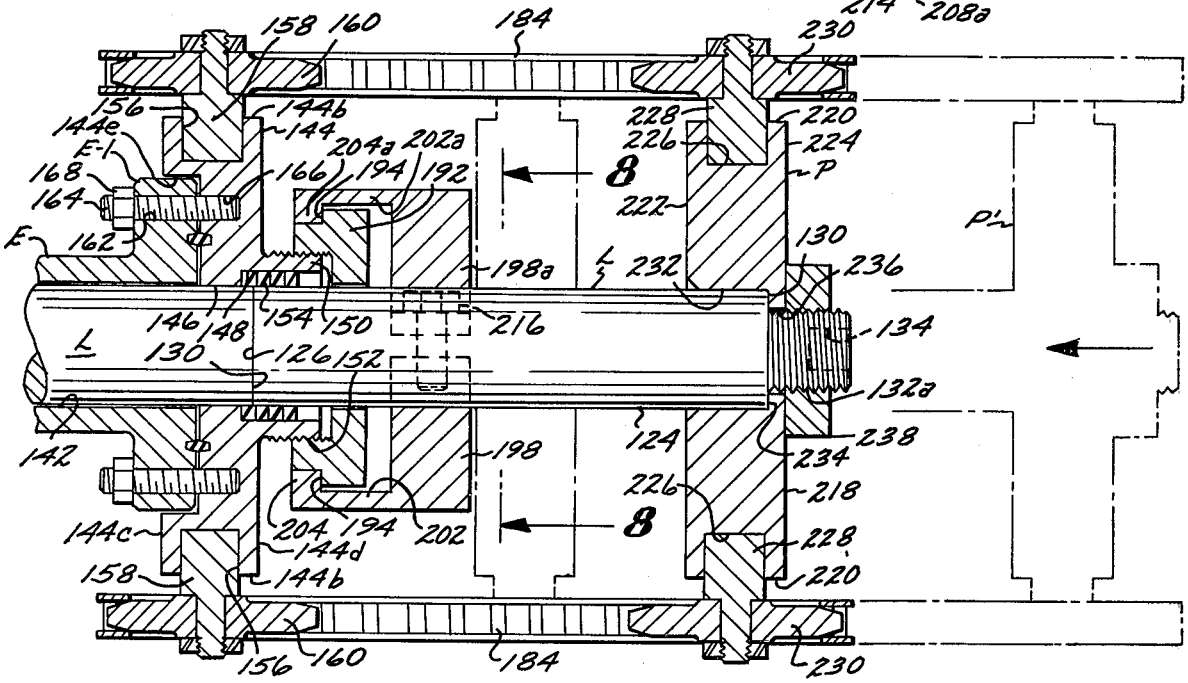
FIG. 7 is a longitudinal cross sectional view of a portion of the elongate member advancing mechanism taken on the line 7—7 of FIG. 2.

The elongate rigid member advancing mechanism N as may best be seen in FIG. 2 is disposed in a fixed position relative to the passage 142 that extends longitudinally through the first gate valve E. The mechanism N includes a heavy vertically disposed plate 144 that has a flat top 144*a*, a pair of end walls that extend downwardly therefrom and are identified by the numerals 144*b*, a forward side wall 144*c*, and a rear side wall 144*d*. A circular cavity 144*e* extends rearwardly from the forward side wall 144*c* as shown in FIG. 7, and has the flange E-1 partially disposed therein. A first bore 146 is formed in the plate 144 and is in communication with the passage 142 in the first gate valve E.

The first bore 146 as best seen in FIG. 7 develops into a second bore 148 of larger diameter. The second bore 148 extends through a tubular boss 150 that projects from the rear side wall 144*d* of the plate 144. The boss 150 has threads 152 formed on the exterior surface thereof. The second bore 148 has resilient packers 154 situated therein as shown in FIG. 7. The pair of end walls 144*b* as best seen in FIG. 7 have a pair of circular recesses 156 extending inwardly therefrom, which recesses are engaged by the inner portions of stub shafts 158, which stub shafts rotatable support a pair of first sprockets 160.

The flange E-1 as shown in FIG. 7 has a number of circumferentially spaced bolt holes 162 extending transversely therethrough, which bolt holes have stud bolts 164 disposed therein that extend into tapped recesses 166 formed in the first plate 144. The flange E-1 is removably held on the plate 144 by the bolts 164 and nuts 168 that engage forwardly extending portions of the bolts as shown in FIG. 7.

The top surface 144*a* of plate 144 has a horizontal support 170 secured thereto, which support has a base 172 mounted thereon that forms a part of a conventional hydraulic jack 174. The jack 174 has a piston rod 176 extending upwardly therefrom, and on the upper extremity thereof supports a transverse shaft 178.

The shaft 178 rotatably supports a pair of spaced second sprockets 180 that are vertically aligned with the first sprockets 160. The hydraulic jack 174 when a handle 182 that forms a part thereof is pivotally reciprocated moves the piston rod 176 upwardly. The jack 174 includes a release to permit downward movement of the piston rod. The pair of second sprockets 180 may be moved between the position shown in solid line in FIG. 2 to that illustrated in phantom line in the same figure.

A pair of lengths of chain belts 184 are provided that have first ends 184*a* that have first threaded rods 186 secured thereto, which rods extend downwardly through openings in a pair of lugs 188 that are secured to the base 172. The downwardly projecting ends of the threaded rods 186 have nuts 190 secured thereto, which nuts are in abutting contact with the lower surface of the lugs 188. The pair of lengths of chain belts 184 as best seen in FIG. 2 extend upwardly from the first threaded rods 186 and over the second pair of sprockets 180 and then downwardly to engage the pair of first sprockets 160.

In FIG. 7 it will be seen that an anchor ring 192 that is internally threaded engages the threads 152 of the boss 150, with the anchor ring including a forwardly disposed, circumferentially extending body shoulder 194. Also, in FIG. 8 it will be seen that a clamp assembly 196 is provided that is defined by first and second semi-circular clamp members 198 and 198*a*. The clamp member 198*a* have semicircular interior surfaces 200 and 200*a*, which interior surfaces are substantially the same radii of curvature as that of the exterior cylindrical surface of one of the rigid elongate members L.

Figure 8:
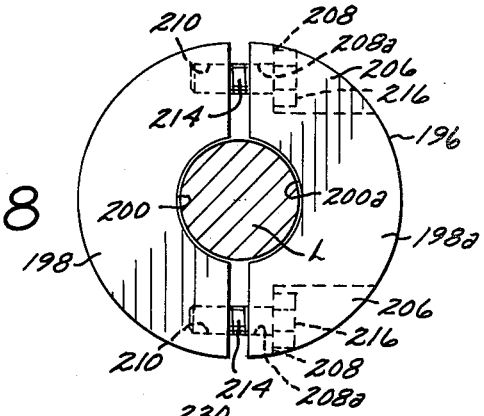
FIG. 8 is an end elevational view of a clamp that forms a part of the elongate member advancing mechanism taken on the line 8—8 of FIG. 7, with the clamp in a first position.

The first and second clamp members 198 and 198*a* have first and second legs 202 and 202*a* extending forwardly therefrom, which pair of legs on the forward ends support first and second semi-circular lugs 204 and 204*a* that removably engage the anchor ring 192 forwardly of the body shoulder 194 as shown in FIG. 7. Two spaced recesses 206 are formed in the first semicircular clamp member 198*a* as shown in FIG. 8, which recesses on their inner ends terminate in abutment 208 from which bores 208*a* extend.

The bores 208*a* are in axial alignment with a pair of transverse tapped bores 210 formed in the first clamp member 198. Two bolts 214 extend through the bores 208*a* to engage the tapped bores 210, with the bolts having heads 216 that may be caused to bear against the abutments 208 when the bolts are rotated by a suitable wrench. The clamp members when in the first position shown in FIG. 8 permit one of the elongate rigid membes L to be moved longitudinally therethrough. However, when the bolts 214 are rotated in a first direction, the clamp members 198 and 198*a* are drawn together to frictionally engage the elongate member L that they encircle.

A force exerting assembly P is shown in FIG. 7 that includes a second heavy plate 218 that has a pair of end surfaces 220, a forward side surface 222, and a rearward side surface 224. The pair of end surfaces 220 have a pair of recesses 226 extending inwardly therefrom that support stub shaft 228, which stub shafts rotatably support third sprockets 230 in alignment with the first sprocket 160.

The second plate 218 has a centered first bore 232 extending rearwardly therein that terminates in a circular body shoulder 234 from which a second bore 236 of smaller diameter extends rearwardly. The bore 232 is of such diameter as to slidably engage the exterior surface of one of the elongate rigid members L, with the second end 130 of the rigid member being in abutting contact with the body shoulder 234, and the threaded extension 132*a* of the rigid member extending through the second bore 236 and outwardly therefrom. The outwardly extending portion of the threaded extension 132 is removably engaged by a nut 238 as shown in FIG. 7.

The chain link belts 184 extend rearwardly from the first sprockets 160 to engage the pair of third sprockets 230 and then extend forwardly therefrom. The chain link belts 184 have second ends 184*b* from which second threaded rods 240 extend and pass through a pair of openings 242 defined in a pair of lugs 244 secured to the first plate 144. The force exerting assembly P can move rearward and away from the first plate 144 to the position shown in phantom line in FIG. 7 which is identified by the letter P'.

Figure 9:
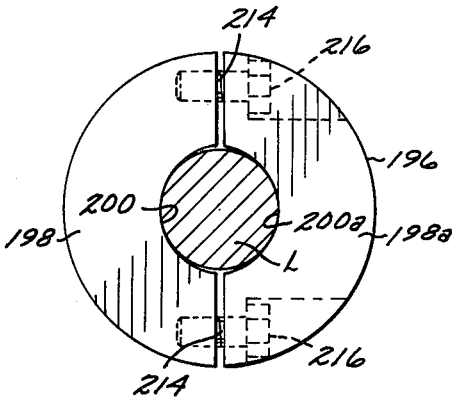
FIG. 9 is the same view as shown in FIG. 8, but with the clamp in a second position where it is in frictional engagement with one of the elongate rigid members.

The use and operation of the invention A is as follows. The clamp assembly 196 is placed in the first position shown in FIG. 8. The elongate rigid member L-1 is now advanced forwardly through the clamp assembly 196 to have the toothed end disposed within the passage 142 of first gate valve E-1. The clamp assembly 196 is now moved to the second position shown in FIG. 9 by rotating the bolt heads 216. The first gate valve E-1 may now be placed in the open position.

The second end of elongate rigid member L-1 now has the first end 126 of an elongate rigid member L screwed thereto as shown in FIG. 7. The force exerting assembly P is now moved forwardly for the second plate 218 to engage the elongate rigid member L as shown in FIG. 7, and the nut 238 thereafter being screwed onto the threads 132*a* as shown in FIG. 7. The first gate valve E-1 is now placed in the open position.

Handle 182 of the jack 174 is now reciprocated upwardly and downwardly to move the piston rod 176 upwardly, with consequent lengthening of the two vertical disposed portions of the length of chain belt 184. As such lengthening takes place, the horizontal portions of the length of chain belt are shortened, with the assembly P being forced to the left to force the elongate rigid member L-1 to the left through the first gate valve passage 142.

Prior to the elongate member L-1 emerging from the passage 16*a* in the tubular lateral 16, the plug assembly K is lowered to the position shown in FIG. 2. Sequential movement of the rigid member L-1 to the left is achieved by causing the clamp assembly 196 to grip a rigid elongate member L adjacent the second end 130. The force exerting assembly P is now moved to the right to accupy the position P shown in phantom line in FIG. 7. A second elongate rigid member L is now screwed onto the clamped rigid elongate member. The second elongate rigid member L is now engaged by the force exerting assembly P in the same manner as previously described. The clamp 196 is now caused to move from the position shown in FIG. 9 to that illustrated in FIG. 8. Handle 182 is again reciprocated to force the first elongate rigid member L-1 to the left as viewed in FIG. 2 to pass through the bore 88 and into the passage 18*a* to remove deposited mineral M from the latter.

When the plug assembly K is so engaged by the sequence of joined rigid elongate members L, the lower first body 64 is restrained from rotating. By gripping the end 62*a* with a wrench (not shown), and rotating the second piston rod 62, piston 58, and first piston 60 are concurrently rotated to rotate the upper second body 92 relative to the first body 64 to radially expand the packing rings 76 into sealing contact with the surface 13*a*.

The pin 110 may now be vertically aligned with the legs 106 of slots 104, and the second piston rod disengaged therefrom. The second gate valve G, second tubular member H, and hydraulic cylinder J, together with piston 58 and first and second piston rods 62 and 60 may now be separated from the first tubular member D to permit maintenance work to be performed on the removed compartments.

When the invention A is to be reassembled the above described sequence of events is reversed. When the release (not shown) on the hydraulic jack 174 is actuated, the force of the pressurized fluid on the first end 136 of the first elongate member L-1 will force it to the right as viewed in FIG. 2 together with the members L connected thereto. The elongate members L are sequentially disconnected from one another by using the clamp assembly 196 to grip the second outermost member L as the outermost member L is unscrewed therefrom.

The member L-1 as it is advanced to the left through the first gate valve E-1 and passage 142 scrapes mineral deposits M therefrom. By loosening or removing the nut 238, the recess 134 in the outermost member L may be engaged by a wrench (not shown) to rotate it together with the sequence of the rigid members L to the left of it, including the first elongate member L-1. When such rotation takes place, the teeth 138 ream the deposited mineral M from the passages.

In FIGS. 11–14 a sectionized elongate rigid member assembly W is shown that includes a ring shaped resilient packer 300 that may be radially expanded to seal with the interior surfaces of either the first or second tubular laterals 16 or 18 after the packer has been disposed therein.

In FIG. 15 the assembly W is illustrated as being advanced to the left to dispose the packer 300 in the second tubular lateral 18. After the packer 300 has been disposed in the second tubular lateral 18 and radially expanded into sealing contact with the interior surface thereof, the second gate valve F shown in FIG. 1 may be removed for repair or replacement without killing the geothermal well B.

By mounting the advancing mechanism N on the second gate valve F, the assembly W may be moved to the right to dispose the resilient packer 300 within the first tubular lateral 16 to be radially expanded into sealing contact with the interior surface thereof. The first gate valve E shown in FIGS. 1 and 15 may then be removed for maintenance purposes without killing the geothermal well B.

The assembly W includes a first tubular elongate member 302 which as may be seen in FIG. 15 occupies a leading position. A number of intermediate elongate tubular members 304 are provided, one of which intermediate members is visible in FIG. 13. An elongate tubular end member 306 is also provided. Each of the tubular membes 302, 304 and 306 are of slightly less external diameter than the internal diameter of the passages **16*a* and 18*a* in the first and second tubular laterals 16 and 18 through which these elongate members may be longitudinally moved as hereinafter explained to seal off a desired one of the tubular laterals with the resilient packer 300**.

The first elongate tubular member 302 has a forwardly disposed ring shaped end surface **302*a* as may best be seen in FIG. 13, and a cylindrical external surface 302*b*. A longitudinal bore 302*c* extends through the first elongate tubular member 302. The first elongate member 302 has a rearward internally threaded portion 302*d*. The first tubular member 302 has a first forward bore extension 302*e* that effects a circumferentially extending body shoulder 302*g* with a second forward bore extension 302*f* situated rearwardly from the first extension. Body shoulder 302*g*** serves as a stop as will later be explained.

Each of the intermediate elongate tubular members 304 includes a portion **304*b* that has an extension 304*a* projecting forwardly therefrom that is externally threaded and is of smaller diameter than the portion 304*b*. A longitudinal bore 304*c* extends through the portion 304*b* as well as the forward extension 304*a*. The intermediate tubular member 304 includes a rearward portion 304*d* that is internally threaded as may best be seen in FIG. 13**.

The end elongate tubular member 306 as shown in FIG. 13 includes a cylindrical body **306*a* that has an externally threaded portion 306*b* of smaller diameter that extends forwardly therefrom. A longitudinal bore 306*c* extends through the cylindrical body 306*a* and the externally threaded portion 306*b*. The end elongate tubular member 306 has a recessed rearward end 306*d* as may be seen in FIG. 13. An anti-friction ring 308 is disposed in the recessed end 306*d*** for reasons that will later become apparent.

A sectionized bolt assembly 310 is used in conjunction with the assembly W. The bolt assembly 310 includes a forward bolt section 312, a number of intermediate bolt section 314, and a rearward bolt section 316 all of which are illustrated in FIG. 13. Only one of the intermediate bolt sections 314 is shown in FIG. 13. The forward bolt section 312 includes a head **312*a* that is of slightly less external diameter than the internal diameters of the passages 16*a* and 18*a* in the first and second tubular laterals 16 and 18. The head 312*a* as shown in FIG. 13 includes a forward surface 312*b* and a rearward ring shaped surface 312*c*. The bolt head 312*a* has a forward shank portion 312*d* extending rearwardly therefrom that develops into a body shoulder 312*e* that serves as a stop as will later be explained. The shank portion 312*d* supports a tubular resilient packer 300 as shown in FIG. 13. An intermediate shank portion 312*f* extends rearwardly from the body shoulder 312*e*, with the intermediate portion having a circumferentially extending groove 312*g* therein. The intermediate shank portion 312*f* is illustrated as having a pair of longitudinal slots 312*h* therein that are best seen in FIG. 14. The forward bolt section has a rearward portion 312*i* as shown in FIG. 13 that develops into an externally threaded rearward extension 312*j* of smaller diameter than the rearward portion 312*i***.

Each of the intermediate bolt sections 314, as shown in FIG. 13, includes a cylindrical body **314*a* that has a forwardly disposed, internally threaded recesses 314*b* defined therein, and a circumferential groove 314*c* extends around the body 314*a*. The cylindrical body 314*a* develops on the rearward end into an externally threaded extension 314*d* that is of smaller diameter than the cylindrical body 314*a***.

The rear bolt section 316 includes a cylindrical portion **316*a* that has a forwardly disposed internally threaded recess 316*b* defined therein and a circumferential groove 316*d* extending around the portion 316*a*. The rear bolt section 316 has a rearwardly extending, externally threaded extension 316*c* that is of substantially smaller diameter than the shank section 316*a*. The rearward externally threaded extension 316*c* as shown in FIG. 13 may be engaged by a nut 318 that has a wrench engageable portion 318*a* and a cup shaped member 318*b* extending forwardly from the nut that rotatably engages the anti-friction ring 308 as shown in FIG. 13**.

The first elongate tubular member 302 as shown in FIG. 14 has two transverse oppositely disposed bores 320 formed therein in which pins 322 are welded or otherwise secured, with the pins 322 extending into the pair of slots 312*h* to prevent rotation of the first, second and third elongate tubular members 302, 304 and 306 relative to the bolt sections 312, 314 and 316. The grooves 312*g*, 314*c* and 316*d*, as may best be seen in FIG. 13 serve to support resilient sealing rings 324, 326 and 328.

The use of the assembly W is much the same as that of the elongate members L previously described. The assembly W will be used after the interior surfaces of the first and second tubular laterals 16 and 18 have been cleaned of solidified mineral deposits.

In FIG. 15 the assembly W is illustrated with the packer 300 on tubular lateral member 16 and from which it may be advanced to the left to plug the passage 18*a* of the second tubular lateral member 18. The plug assembly K shown in FIG. 1 has prior to this operation been moved upwardly to a position above the first and second passages 16*a* and 18*a*. The first elongate tubular member 302, with the forward bolt section 312 therein and the resilient packer 300 supported on the forward portion of the bolt section, is now inserted as a unit into the advancing mechanism N, and the first tubular member 302 frictionally gripped by the clamp members 198 and 198*a*. The second plate P of the advancing mechanism is now moved into abutting contact with the rearward end of the first elongate member 302. The clamp members 198 and 198*a* are now released, and the advancing mechanism N actuated to move the first elongate member 302 and bolt section 312 forwardly. After this movement is completed the rearward portion of elongate member 302 is gripped by the clamps 198 and 198*a*. The second plate P is now moved to the right and an intermediate elongate member 304 is screwed onto the first elongate member 302 and an intermediate bolt section 314 threaded onto the forward bolt section 312.

Second plate P is now placed in abutting contact with the rearward end of the intermediate elongate member 304 and the advancing mechanism N actuated to move the sequence of the elongate members and bolt sections to the left as viewed in FIG. 15. Each intermittent move of the elongate members and bolt sections is concluded by causing the clamp members 198 and 198*a* to frictionally grip the just added elongate rigid member 304. This intermittent advancing is continued until the packer 302 is disposed within the passage 18*a* of tubular lateral 18.

The end elongate member 306 and rear bolt section 316 are now added to the sequence of members above described, with the elongate end member being gripped by the clamps 198 and 198*a*. Second plate P is now moved to the right out of contact with end member 306. Nut 318 is now rotated in an appropriate direction by a wrench (not shown), with the cup shaped portion 318*b* rotating relative to the anti-friction ring 308. As a nut 318 is so rotated the bolt sections 312, 314 and 316 are moved rearwardly relative to the elongate members 302, 304 and 306. The elongate members 302, 304 and 306 cannot rotate relative to the bolt sections 312, 314 and 316, due to the pins 322 slidably engaging the grooves 312*h* as shown in FIG. 14. As rotation of the nut 318 takes place, the packer 300 is longitudinally compressed between the bolt head surface 312*c* and end surface 302*a* to expand radially into pressure sealing contact with the interior surface 18*a* of second tubular lateral 18.

The second valve F may now be removed from the second tubular lateral 18 for repair and replacement without killing the geothermal well B. When it is desired to plug the passage 16*a* in first tubular lateral 16, the advancing mechanism N is mounted on the second gate valve F and the sequential movement of the assembly W then being towards the first tubular lateral.

In both the use of the elongate members L, and the assembly W above described, after it is desired to remove the elongate members L or the assembly W, the fluid pressure of the well will force them towards the gate valve on which the advancing mechanism N is mounted. Of course, prior to the assembly W being so displaced, the nut 318 must be rotated in a direction to allow the packer 300 to return to the position shown in FIG. 11 where it is no greater diameter than that of the first elongate tubular member 302. The body shoulders 312*e* and 302*g* serve as stops to limit the longitudinal compression that may be placed on packer 300.

The use and operation of the invention has been previously described in detail and need not be repeated.

What is claimed is:

1. In combination with a geothermal well that includes casing that extends downwardly from a first flange to a geological zone from which pressurized fluid containing minerals flows; a substantially vertical first tubular member that includes a lower second flange secured to said first flange and an upper third flange, first and second horizontal axially aligned, lateral tubular member that extend outwardly from said first tubular member in opposite directions to terminate in fourth and fifth flanges; first, second and third flanged gate valves secured to said fourth, fifth and third flanges, each of said gate valves having a longitudinal passage therein; a first assembly for cleaning deposited solid minerals from the interior surfaces of said tubular lateral members without killing said well, said first assembly including:

a plurality of elongate rigid members including a first elongate rigid member that include threaded ends that permit said first elongate member to have other of said elongate rigid members removably connected thereto end to end with each of said rigid elongate members having a diameter slightly less than that of said first and second tubular laterals;

b. first means removably mounted on said first gate valve that permit said first elongate rigid member to be inserted in said passage therein and removably grip said first elongate rigid member when said first gate valve is placed in an open position and said first elongate rigid member has a leading end thereof subject to said pressurized fluid; and c. second means operatively associated with said first means for intermittently moving said first elongate member forwardly through said first gate valve when said first gate valve is in an open position, with each intermittent move occurring after one of said rigid elongate members is connected to said first elongate rigid member and others of said elongate rigid members are sequentially added thereto, and each intermittent move being preceded by said first means releasing said grip on one of said elongate rigid members and re-establishing said grip on the one of said rigid elongate members that has been added thereto after said intermittent move has been completed, and said first elongate rigid member as it advances through said first tubular lateral scraping said deposited foreign material from the interior surface thereof.

2. A first assembly as defined in claim 1, in which said second means rotatably engages a rearward end of the one of said rigid elongate members that has been connected to the one of said rigid elongate members that is gripped by said first means, with the leading end of said first elongate rigid members including a plurality of teeth defined thereon, and said first assembly in addition including; and c. third means for intermittently rotating said plurality of rigid elongate members connected to one another and to said first elongate rigid members as they are intermittently moved forwardly by said second means for said teeth to ream deposited foreign material from the interior surface of said first tubular lateral.

3. A first assembly as defined in claim 2, in which said third means are a plurality of recesses of non-circular transverse cross section formed in the rearwardly disposed ends of said elongate rigid members when the latter are connected end to end, with said recess in the most rearwardly disposed of said rigid elongate rigid members being removably engageable by a wrench to concurrently rotate the plurality of said elongate rigid members connected end to end as they are intermittently advanced through said first tubular lateral.

4. A first assembly as defined in claim 1, in which said second means includes a hydraulic jack, a piston rod, and a handle that may be manually reciprocated to move said piston outwardly relative to said jack, with said outward movement of said piston exerting a forward force on the rearwardmost one of said elongate members that has been connected to said first elongate rigid member, and said force intermittently moving said first elongate member forwardly when said first means is caused to release said grip.

5. A first assembly as defined in claim 1, in which said first means is:

d. a first vertically positionable plate that has an upper horizontal surface from which a pair of end surfaces extend downwardly and a forward and rearward side surface, and an externally threaded tubular boss that extends rearwardly from said rearward side surface and communicates with a transverse bore in said first plate, said bore and the interior of said boss of a diameter to permit said elongate rigid members to be slid longitudinally therethrough;

e. third means for securing said first plate to said first gate valve, with said transverse bore coaxially aligned with said passage in said first gate valve;

f. an internally threaded anchor ring that removably engages said externally threaded tubular boss;

g. first and second generally semi-circular clamp members that have first and second arcuate interior surfaces that may frictionally grip the exterior surface of one of said elongate rigid member when said first and second clamp member are moved towards one another, said first clamp member having a pair of transverse bores therein that are axially alignable with a pair of tapped recesses in said second clamp member; a pair of bolts that extend through said pair of transverse bores to engage said pair of tapped recesses, said bolts when rotated in a first direction moving said first and second clamp members from first positions where they do not frictionally grip one of said elongate rigid members to second position where they frictionally grip one of said elongate members;

h. first and second legs that extend forwardly from said first and second clamp members; and i. first and second semi-circular lugs supported from the forward extremities of said first and second legs that extend inwardly towards one another to removably engage said anchor ring to support said third means therefrom.

6. An assembly as defined in claim 5, which in addition includes:

j. sealing means operatively associated with said externally threaded tubular boss for sealing with the exterior surface of one of said elongate rigid members when the latter extends longitudinally through said externally threaded tubular boss.

7. A first assembly as defined in claim 5, in which each of said rigid elongate members has a forward and rearward end, each of said forward ends having a tapped cavity extending longitudinally therefrom, and each of said rearward ends having an externally threaded extension of smaller diameter projecting longitudinally therefrom, each of said extensions and rearward ends defining a ring shaped first body shoulder, with each of said threaded extensions capable of engaging said tapped cavity of one of said elongate rigid members forwardly therefrom.

8. A first assembly as defined in claim 7, in which said second means includes:

i. a second substantially vertical plate that has a pair of end surfaces and a forward and rearward end surface, a bore and counterbore that extend between said end surfaces and define a ring shaped body shoulder at their junction, said counterbore of slightly greater diameter than that of said threaded extensions;

j. a hydraulic jack mounted on said first plate and extending upwardly therefrom, said jack including a cylinder; a piston rod extending upwardly from said cylinder, said piston rod having an upper end; a transverse cross piece mounted on said upper end; a pivotally supported handle on said jack that when reciprocated moves said piston rod upwardly, and a release on said jack that permits said piston to move downwardly;

k. first, second and third pairs of laterally spaced sprockets that lie in first and second vertical planes, said first pair of sprockets, rotatably supported from opposite sides of said first plate, said second pair of sprockets rotatably supported on said cross piece, and said third pair of sprockets rotatably supported from said end surface of said second plate;

l. a pair of lengths of link chain that have first and second ends;

m. fourth means for securing said first ends at fixed positions relative a lower portion of said hydraulic jack, each of lengths of link chain extending upwardly over one of said second sprockets and then downwardly and rearwardly to engage one of said first and third sprockets and then forwardly from one of said third sprockets;

n. fourth means for securing said second ends at fixed positions relative said first plate, with said second plate when a rearward end portion of one of said elongate rigid members is disposed in said bore and said threaded extension projecting rearwardly through said counter bore capable of having said second body shoulder exert a forward force on said first body shoulder most adjacent thereto and said elongate rigid members forwardly therefrom when said handle is reciprocated to move said piston rod upwardly to shorten the portions of said lengths of link chain that extend between said second and third pairs of sprockets.

9. A first assembly as defined in claim 1, in which said rigid elongate members are tubular and in addition includes:

d. a bolt that has a head disposed forwardly of said first elongate rigid member and a threaded shank extending rearwardly therefrom through said first elongate rigid member, said head of no greater diameter than the external diameters of said rigid elongate members, and said shank of a diameter substantially less than said head;

e. a resilient packing ring mounted on said shank and disposed between said head and the forward extremity of said first elongate rigid member, and a longitudinal slot in said shank rearwardly from said packing ring;

f. third means that extend inwardly from said first elongate rigid member that slidably engage said longitudinal slot to prevent said bolt and first elongate rigid member from rotating relative to one another;

g. a plurality of bolt extensions having threaded ends that permit said bolt extensions to be sequentially connected to said bolt and to one another to extend rearwardly through said elongate rigid members and outwardly beyond the rearmost of said elongate rigid members after said elongate rigid members have been advanced to dispose said resilient packing ring within said second tubular lateral; and h. a nut that engages the threaded rearward extremity of the most rearmost bolt extension, with said nut when rotated in an appropriate direction drawing said bolt head rearwardly to laterally compress said resilient packing ring and radially expand said resilient packing ring into pressure sealing contact with the interior surface of said second tubular lateral to permit said second gate valve to be removed for repair or replacement without killing said geothermal well.

10. A first assembly as defined in claim 1, which in addition includes a second assembly that permits said third gate valve to be removed for replacement or repair without killing said geothermal well, said second assembly including:

d. a second vertical tubular member removably and coaxially mounted on said third gate valve and extending upwardly therefrom;

e. a plug assembly that includes upper and lower bodies, said lower body having a transverse bore extending therethrough; thread means that rotatably connect said upper and lower bodies; radially expandable resilient sealing means that encircle said plug assembly and expand from a first to a second position when said upper body is rotated from a first to a second position relative to said lower body; and engageable means on said upper body which when engaged permit said plug assembly, when said resilient sealing means is in said first position, to be moved longitudinally through said first and second tubular members and third gate valve when the latter is in an open position, allows said plug assembly to be rotated as a unit when said resilient means is in said first position, and permits said upper body to be rotated to either said first or second position when movement of said lower body is restrained, said resilient sealing means when said plug assembly is in said first tubular member sealing with the interior of the latter when said resilient sealing means is in said second position;

f. an elongate rigid, vertically disposed member that is longitudinally movable in said first and second tubular members and said third gate valve when the latter is in an open position, said member having a lower end;

g. engaging means on said lower end of said rigid, vertically disposed member for removably engaging said engageable means;

h. third means for moving said member longitudinally in said first and second tubular members and said gate valve when the latter is in an open position together with said plug assembly when said engageable and engaging means are in engagement;

i. fourth means for visually indicating the longitudinal location to which said plug assembly has been moved by said member;

j. fifth means for rotating said member and plug assembly;

k. sixth means for visually indicating the degree that said fifth means has rotated said member and plug assembly from a first predetermined position, said plug assembly when in a first location in said first tubular member capable of being rotated to a second position where said transverse bore is coaxially aligned with the interior of said first and second tubular laterals with said plug assembly when so disposed having said plurality of elongate rigid members advanced through said transverse bore to engage said second tubular lateral to restrain rotation of said lower body and prevent upward movement of said plug assembly, with said upper body capable of being rotated from said first to said second position by said vertically disposed member to expand said sealing means to said second position to seal with the interior of said first tubular member, with said engaging means when disengaged from said engageable means allowing said vertically disposed member, third gate valve, second tubular member and third means to be separated from said first tubular member without killing said geothermal well.

11. A second assembly as defined in claim 10, in which said elongate, rigid vertically disposed member is a first piston rod and said third means is:

l. a hydraulic cylinder mounted on said second tubular member, said cylinder including an upper end;

m. a piston longitudinally movable in said hydraulic cylinder that has said first piston rod secured thereto; and n. seventh means for discharging a pressurized fluid into and out of said hydraulic cylinder to move said piston longitudinally therein.

12. A second assembly as defined in claim 11, in which said fourth means is:

o. a second piston rod that extends upwardly from said piston through said upper end of said hydraulic cylinder; and p. graduations on said second piston rod that visually indicate the longitudinal position of said plug assembly when said first piston rod has said engaging means thereon in engagement with said engageable means on said plug assembly.

13. A second assembly as defined in claim 12, in which said fifth means is:

q. an upper end portion of said second piston rod that is of non-circular transverse cross section that may be removably engaged by a wrench to concurrently rotate said second piston rod, piston, and first rod, as well as at least said upper body of said plug assembly when said engaging means are in engagement with said engageable means.

14. A second assembly as defined in claim 13, in which said sixth means is a first insignia on said second piston rod and a second insignia on said upper end of said hydraulic cylinder, with the space between said first and second insignias indicating the extent to which said second piston rod, piston, and first piston rod has been rotated relative to said second insignia.

* * * * *